US005451334A

United States Patent [19]

Bongardt et al.

[11] Patent Number: 5,451,334

[45] Date of Patent: Sep. 19, 1995

[54] ENVIRONMENT-FRIENDLY BASIC OIL FOR FORMULATING HYDRAULIC FLUIDS

[75] Inventors: Frank Bongardt, Duesseldorf; Karl Schmid, Mettmann; Reinhold Wuest, Kaarst, all of Germany

[73] Assignee: Henkel Kommanditgesellschaft auf Aktien, Duesseldorf, Germany

[21] Appl. No.: 342,996

[22] Filed: Nov. 21, 1994

Related U.S. Application Data

[63] Continuation of Ser. No. 135,365, Oct. 12, 1993, abandoned, which is a continuation of Ser. No. 829,082, filed as PCT/EP90/01296, Aug. 8, 1990, abandoned.

[30] Foreign Application Priority Data

Aug. 17, 1989 [DE] Germany ..... 39 27 155.2

[51] Int. Cl.[6] ..... C10M 169/04; C10M 101/04

[52] U.S. Cl. ..... 252/56 R; 252/56 S; 252/52 R; 252/79

[58] Field of Search ..... 252/56 R, 56 S, 52 R, 252/79, 77

[56] References Cited

U.S. PATENT DOCUMENTS

| | | | |
|---|---|---|---|
| 2,305,228 | 12/1942 | Woodhouse et al. | 252/79 |
| 2,889,354 | 6/1959 | Blake et al. | 252/56 S |
| 3,970,574 | 7/1976 | Niedzielski | 252/79 |
| 4,025,447 | 5/1977 | Mancini et al. | 252/56 S |
| 4,210,543 | 7/1980 | Milnes et al. | 252/46.7 |
| 4,783,274 | 11/1988 | Jokinen et al. | 252/56 R |
| 5,057,247 | 10/1991 | Schmid et al. | 252/56 R |
| 5,273,672 | 12/1993 | Dasai et al. | 252/56 R |

FOREIGN PATENT DOCUMENTS

| | | |
|---|---|---|
| 3419415 | 11/1985 | Germany . |
| 63-125598 | 5/1988 | Japan . |

OTHER PUBLICATIONS

Booser, Handbook of Lubrication, vol. I, p. 83 (1983).
Booser, Handbook of Lubrication, vol. II, pp. 247–249 (1984).

*Primary Examiner*—Prince Willis, Jr.
*Assistant Examiner*—Alan D. Diamond
*Attorney, Agent, or Firm*—Ernest G. Szoke; Wayne C. Jaeschke; Real J. Grandmaison

[57] ABSTRACT

An environment-friendly basic oil based on natural materials for the formulation of hydraulic oils having improved viscosity at elevated temperature and lower pour point contains rapeseed oil or soybean oil as the main component, an antioxidant selected from methoxyphenol, ethoxyphenol, butyl hydroxyanisole, butyl hydroxytoluene, methoxyhydroquinone, ethoxyhydroquinone, tertiary butyl hydroquinone, and tocopherol, and an ester of a monocarboxylic acid or a fatty acid.

11 Claims, No Drawings

ENVIRONMENT-FRIENDLY BASIC OIL FOR FORMULATING HYDRAULIC FLUIDS

This application is a continuation of application Ser. No. 08/135,365 filed on Oct. 12, 1993,now abandoned, which is a continuation of Ser. No. 07/892,082 filed on as PCT/EP90/01296, Aug. 8, 1990, now abandoned.

BACKGROUND OF THE INVENTION

1. Field of the invention

This invention relates generally to hydraulic fluids and, more particularly, to hydraulic oils for hydrostatic power transmission.

Hitherto, most hydraulic oils have been made from mineral oil. In applications where the escape of oil into the environment is a possibility, for example through unavoidable leakages, there is an increasing demand for hydraulic oils which contain environment-friendly ester oils, particularly those based on rapeseed oil and/or soybean oil, as the oil base. Typical applications of the type in question are forestry and agricultural machinery and equipment, dredgers and the like. Applications such as these now require the use of hydraulic oils of water hazard class O. Ester-based hydraulic oils are capable of satisfying these requirements.

2. Discussion of Related Art

However, the above-mentioned ester oils essential for practical application, i.e. rapeseed oils and/or soybean oils which have been purified and, in particular, freed from amylopectins and other mucilaginous substances, have two crucial weaknesses in practical application, namely:

Ester oils based on unsaturated fatty acid systems tend to thicken rapidly, even at only moderately elevated operating temperatures of, for example, 50° to 80° C. This is attributable to the readiness of the olefinic double bonds of the ester-forming acids of the type of oil in question to enter under the effect of atmospheric oxygen into reactions which ultimately lead to an increase in viscosity. Although it is basically known that unwanted increases in viscosity can be counteracted by addition of antioxidants, it has been found that the antioxidants hitherto preferably used in hydraulic oils based on mineral oils do not perform satisfactorily in ester oils of the type in question.

Another important limitation for hydraulic oils based on the environment-friendly ester oils mentioned above is their inadequate stability at low temperatures. Purified rapeseed oil, for example, has a solidification point or pour point of −16° C. Even before the solidification point is reached, the oil undergoes a significant increase in viscosity with falling temperatures. The comparatively high solidification point of rapeseed oil, for example in winter conditions, presents considerable problems for the practical application of the hydraulic oils at low ambient temperatures. In practical application, these problems can of course be dramatically aggravated by the fact that oxidative thickening of an ester oil of the above-mentioned type is accompanied by a considerable reduction in the solidification point of the hydraulic oil. The addition of pour point depressants does not solve the technical problem involved. It is known that the effect of pour point depressants disappears in the event of prolonged residence in the oil to be treated.

DESCRIPTION OF THE INVENTION

The problem addressed by the present invention was to provide effective remedies for the two above-described principal drawbacks of hydraulic oils based on environment-friendly basic oils. More particularly, the object of the invention on the one hand was effectively to stabilize ester oils containing substantial proportions of highly unsaturated fatty acids in the ester mixture against oxidative thickening by addition of selected antioxidants and, on the other hand, to provide mixture components, again based on ecologically safe ester oils, with which a substantial reduction in the solidification point in the hydraulic oil could be effectively achieved over indefinite periods of use.

In a first embodiment, therefore, the present invention relates to an environment-friendly basic oil based on natural materials for the formulation of hydraulic oils having improved viscosity and/or low-temperature stability in practical application containing a) purified rapeseed oil and/or soybean oil as the main oil component, b) 0.5 to 5% by weight, based on the mixture as a whole, of antioxidants selected from the group consisting of methoxyphenol, ethoxyphenol, butyl hydroxyanisole, butyl hydroxytoluene, methoxyhydroquinone, ethoxyhydroquinone, tert. butyl hydroquinone and/or tocopherol.

If desired, these ester oils to which the antioxidants selected in accordance with the invention are added contain as an additional mixture component c) esters of trimethylol ethane, trimethylol propane and/or neopentyl glycol with monocarboxylic acids of the following subclasses c1) saturated $C_{5-10}$ monocarboxylic acids and/or c2) fatty acids based on rapeseed oil, soybean oil and/or technical grade oleic acid, the ester components (c) being present in at most substantially equal quantities to the main oil component (a).

In another embodiment, the present invention relates to an additive containing antioxidants for stabilizing the viscosity of hydraulic oils based on rapeseed oil and/or soybean oil, characterized in that it contains one or more of the following antioxidants: methoxyphenol, ethoxyphenol, butyl hydroxyanisole, butyl hydroxytoluene, methoxyhydroquinone, ethoxyhydroquinone, tert. butyl hydroquinone and/or tocopherol.

If desired, these selected antioxidants are present in solution in a preferably high-boiling solvent which, in turn, is soluble in the ester oils based on rapeseed oil and/or soybean oil forming the principal oil component.

Finally, another embodiment of the invention relates to the use of esters of trimethylol ethane, trimethylol propane and neopentyl glycol with monocarboxylic acids of the following subclasses c1) saturated $C_{5-10}$ monocarboxylic acids and/or c2) fatty acids based on rapeseed oil, soybean oil and/or technical grade oleic acid for mixing with environment-friendly hydraulic oils based on rapeseed oil and/or soybean oil, the outcome being a reduction in the pour point and an improvement in the low-temperature stability of the ester-based hydraulic oil.

Further particulars of the composition of the hydraulic oils can be found in the relevant prior art, cf. in particular "Ullmanns Enzyklopädie der technischen Chemie", 4th Edition (Verlag Chemie, Weinheim), Vol.

13, pages 85 et seq., "Hydraulikflüssigkeiten (Hydraulic Fluids)" and also Dieter Klamann "Schmierstoffe und verwandte Produkte, Herstellung, Eigenschaften, Anwendung (Lubricants and Related Products, Production, Properties, Uses)", Verlag Chemie, Weinheim, 1982, pages 147/148, 11.9 Hydrauliköle (Hydraulic Oils).

The mixtures according to the invention differ from the known mineral-oil-based hydraulic oils widely used in practice in the choice of the environment-friendly ester oils of the above-mentioned type as the basic component of the hydraulic oil. The particular features of the invention will now be described with reference to the above-mentioned first embodiment of the invention, i.e. with reference to the ecologically safe basic oils based on natural materials for the formulation of the hydraulic oils.

Purified ester oils which form the main oil component and which may optionally have been additionally refined by at least partial decoloration are inexpensively available as commercial products. Particularly suitable rapeseed oils are the types free from erucic acid which are now widely used.

Rapeseed oil of this category typically has a solidification point of −16° C. A distinct reduction in the pour point or solidification point can be obtained by addition of the selected esters of trimethylol ethane, trimethylol propane and/or neopentyl glycol. In the two subclasses mentioned, the ester-forming acids of these mixture components are selected so that they combine the desired improvement in viscosity, particularly at low temperatures, with high environmental compatibility. Accordingly, it is preferred in accordance with the invention to use fatty acids of natural origin in both ester subclasses.

The first ester component based on the trimethylol derivatives mentioned uses comparatively low, more particularly saturated, carboxylic acids containing at most 10 carbon atoms as the ester-forming carboxylic acids. One known natural starting material of this type are the so-called head-fractionated fatty acids, i.e. linear saturated monocarboxylic acids containing 6 to 10 carbon atoms. The esters of this groups are distinguished by particularly low solidification points and, accordingly, are particularly suitable for improving the low-temperature behavior of the main oil components in the desired sense.

However, the ester-forming carboxylic acids from the second group of trimethylol derivatives described in accordance with the invention are also structurally suitable for the intended application by virtue of the high concentration of olefinically mono- and/or polyunsaturated carboxylic acids of rapeseed oil or soybean oil or of oleic acid.

Mixtures of these two subclasses of trimethylol ethane, trimethylol propane or neopentyl glycol esters are preferably used in accordance with the invention. In one preferred embodiment, the lesser represented ester component is present in quantities of at least about 20% by weight, based on the ester mixture to be added to the main oil component. According to the invention, it can be particularly preferred to use predominant quantities of the trimethylol esters based on lower fatty acids containing at most 10 carbon atoms in the ester mixture. According to the invention, it is thus possible to reduce the solidification point of rapeseed oil, for example, to −40° to −45° C. By virtue of their high environmental compatibility, these ester components may safely be added to the main oil component in up to substantially equal proportions of the ester mixture to be added, based on the main oil component, without any danger of an unwanted reduction in the required environmental compatibility.

The stabilizers proposed in accordance with the invention as antioxidants are compounds known per se from the class of phenolic inhibitors or corresponding compounds having a basic hydroquinone structure. Nevertheless, the choice of these particular stabilizers is not an obvious choice. It has been found that the choice made in accordance with the invention enables the ester oils or ester oil mixtures used in accordance with the invention to be inhibited surprisingly effectively against unwanted increases in viscosity by ageing in air. Accordingly, the life and usefulness of the hydraulic oils based on natural materials can be prolonged to a hitherto unknown extent for substantially constant material properties.

It is known that hydraulic oils are not only required to show the high low-temperature stability mentioned above, the basic oil is also required to undergo only a minimal change in viscosity immediately after its production on the one hand and after exposure to heat in the presence of air on the other hand. The viscosity properties of hydraulic oils are described in the definition of different viscosity classes in ISO 3448 or DIN 51519. Under this definition, the following meanings apply:

| | Viscosity ($mm^2/s$) at 40° C. | |
|---|---|---|
| | Min. | Max. |
| ISO-VG 22 | 19.8 | 24.2 |
| ISO-VG 32 | 28.8 | 35.2 |
| ISO-VG 46 | 41.4 | 50.6 |
| ISO-VG 68 | 61.2 | 74.8 |

Depending on the ratios in which the ester oils are mixed in accordance with the invention and on the choice of the inhibitors defined in accordance with the invention, viscosity classes ISO-VG 22, ISO-VG 32 and ISO-VG 46 can be established and maintained over long periods of use with the mixtures according to the invention.

The quantity in which the inhibitor class according to the invention is added to the basic oil is in the range from 0.5 to 5% by weight, based on the ester oil mixture as a whole. It may be advisable in this regard to make the inhibitors available as an additive in solution in a solvent. The requirements which the solvent selected has to satisfy include the solubility of the inhibitors selected over a wide temperature range and the homogeneous miscibility even of this solvent in the ester oil mixture. In addition, the solvent selected should show sufficiently low volatility. Ester oils of diverse composition may be used as the solvent.

The formulation of a hydraulic oil from the basic oils formulated in accordance with the invention requires the addition of further components in known manner. Thus, the following further components in particular may be added to the basic oils described in accordance with the invention:

High-pressure additives

These additives are, in particular, sulfurized triglycerides, sulfurized fatty acid alkyl esters, sulfurized sperm oils, phosphoric acid esters, such as trioleyl alcohol phosphate or triaryl phosphate.

Anti-wear additives

Suitable anti-wear additives are, in particular, zinc dialkyl dithiophosphate compounds, such as zinc-(di-2-ethylhexyldithiophosphate)

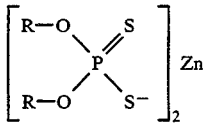

Pour point depressants

One example of a suitable pour point depressant is the product marketed by applicants under the trade name of "Edenor 2410".

Further particulars of the special formulation of hydraulic oils, their additives and the quantities in which these additives are used can be found in the prior publications on this class of materials cited in detail in the foregoing.

The following Examples describe the effects obtainable in accordance with the invention with main oil components based on rapeseed oil and soybean oil and compare these results with corresponding mixtures which do not correspond to the definition accordance with the invention.

EXAMPLES

Example 1

A mixture of 99% rapeseed oil and 0.33% each off butyl hydroxyanisole, tert. butyl hydroquinone and tocopherol having an initial viscosity of 36 $mm^2/s$ at 40° C. was stored for 112 hours at 200° C. in an open vessel. Thereafter, the mixture had a viscosity of 69 $mm^2/s$ at 40° C. The oil is liquid at −15° C.

Comparison Example 1

Rapeseed oil having a viscosity of 36 $mm^2/s$ was stored for 112 hours at 200° C. in an open vessel. Thereafter, the mixture had a viscosity of 200 $mm^2/s$ at 40° C.

Example 2

A mixture of 69% rapeseed oil, 30% trimethylol propane tricaprylate and 0.33% each of butyl hydroxyanisole, tert. butyl hydroquinone and tocopherol having an initial viscosity of 29 $mm^2/s$ at 40° C. was stored for 106 hours at 200° C. in an open vessel. Thereafter the mixture had a viscosity of 50 $mm^2/s$ at 40° C. The mixture is liquid at −25° C.

Comparison Example 2

A mixture of 70% rapeseed oil and 30% trimethylol propane tricaprylate was stored for 106 hours at 200° C. Thereafter the mixture has a viscosity of 160 $mm^2/s$ at 40° C. The mixture is solid at −16° C.

Example 3

A mixture of 50% rapeseed oil, 25% trimethylol propane trioleate, 25% trimethylol propane tricaprylate and 0.33% each of butyl hydroxyanisole, tert. butyl hydroquinone and tocopherol having an initial viscosity of 33 $mm^2/s$ was stored for 110 hours at 200° C. in an open vessel. Thereafter the mixture had a viscosity of 52 $mm^2/s$ at 40° C. The mixture is liquid at −30° C.

Comparison Example 3

A mixture of 50% rapeseed oil, 25% trimethylol propane trioleate and 25% trimethylol propane tricaprylate having an initial viscosity of 33 $mm^2/s$ at 40° C. was stored for 110 hours at 200° C. in an open vessel. Thereafter the mixture had a viscosity of 130 $mm^2/s$ at 40° C. The mixture is liquid at −30° C.

We claim:

1. A hydraulic oil composition for hydrostatic power transmission having low viscosity, low pour points, and low-temperature stability consisting of, a) purified rapeseed oil or soybean oil as the main oil component, b) 0.5 to 5% by weight, based on the weight of the composition, of an antioxidant selected from the group consisting of methoxyphenol, ethoxyphenol, butyl hydroxyanisole, butyl hydroxytoluene, methoxyhydroquinone, ethoxyhydroquinone, tertiary butyl hydroquinone, and tocopherol, and c) an ester selected from the group consisting of trimethylol ethane, trimethylol propane, and neopentyl glycol reacted with a monocarboxylic acid which is c1) a saturated $C_5$–$C_{10}$ monocarboxylic acid, c2) a fatty acid derived from a source selected from the group consisting of rapeseed oil, soybean oil, and technical grade oleic oil, or mixtures of c1) and c2), wherein said ester component c) is present in at most about equal quantities with respect to said main oil component a).

2. A hydraulic oil composition as in claim 1 wherein said ester component c) is present in the form of an ester mixture of the carboxylic acids of said component c1) and said component c2).

3. A hydraulic oil composition as in claim 2 wherein said ester mixture contains a higher proportion of esters of said component c1) than of esters of said component c2).

4. A hydraulic oil composition as in claim 1 wherein said c1) component is of natural origin.

5. A hydraulic oil composition as in claim 1 wherein said component b) is present in a solvent which is soluble in said component a).

6. The process of stabilizing the viscosity, lowering the pour point, and improving the low-temperature stability of a hydraulic oil composition consisting of, a) purified rapeseed oil or soybean oil, consisting of adding to said hydraulic oil composition an additive consisting of b) from 0.5 to 5% by weight, based on the weight of the additive plus hydraulic oil composition, of an antioxidant selected from the group consisting of methoxyphenol, ethoxyphenol, butyl hydroxyanisole, butyl hydroxytoluene, methoxyhydroquinone, ethoxyhydroquinone, tertiary butyl hydroquinone, and tocopherol, and c) an ester selected from the group consisting of trimethylol ethane, trimethylol propane, and neopentyl glycol reacted with a monocarboxylic acid which is c1) a saturated $C_5$–$C_{10}$ monocarboxylic acid, and c2) a fatty acid derived from a source selected from the group consisting of rapeseed oil, soybean oil, and technical grade oleic oil, or mixtures of c1) an c2) wherein said ester component c) is present in at most about equal quantities with respect to said oil component a).

7. The process as in claim 6 wherein said ester component c) is present in the form of an ester mixture of the carboxylic acids of said component c1) and said component c2).

8. The process as in claim 7 wherein said ester mixture contains a higher proportion of esters of said component c1) than of esters of said component c2).

9. The process as in claim 6 wherein said c1) component is of natural origin.

10. The process as in claim 6 wherein said component b) is present in a solvent which is soluble in said component a).

11. A hydraulic oil composition consisting of purified rapeseed oil or soybean oil and mixtures thereof as the main oil component, an ester selected from the group consisting of trimethylol ethane, trimethylol propane, and neopentyl glycol reacted with a monocarboxylic acid which is a saturated $C_5$–$C_{10}$ monocarboxylic acid, or a fatty acid derived from a source selected from the group consisting of rapeseed oil, soybean oil, and technical grade oleic oil, wherein said ester present in at most about equal quantities with respect to said oil component, and 0.5 to 5% by weight of an antioxidant for stabilizing the viscosity of the hydraulic oil composition selected from the group consisting of methoxyphenol, ethoxyphenol, butyl hydroxyanisole, butyl hydroxytoluene, methoxyhydroquinone, ethoxyhydroquinone, tertiary butyl hydroquinone, and tocopherol, based on the weight of the composition.

* * * * *